United States Patent [19]

Yamamoto et al.

[11] Patent Number: 4,544,406

[45] **Date of Patent: * Oct. 1, 1985**

[54] SPRING STEEL HAVING A GOOD SAG-RESISTANCE AND A GOOD HARDENABILITY

[75] Inventors: Toshiro Yamamoto, Tokai; Ryohei Kobayashi, Chita; Mamoru Kurimoto, Tokonabe; Toshio Ozone, Nagoya, all of Japan

[73] Assignees: Aichi Steel Works, Ltd., Tokai; Chuo Hatsujo Kabushiki Kaisha, Nagoya, both of Japan

[ * ] Notice: The portion of the term of this patent subsequent to May 15, 2001 has been disclaimed.

[21] Appl. No.: 405,802

[22] Filed: Aug. 6, 1982

[30] Foreign Application Priority Data

Nov. 8, 1981 [JP] Japan ..... 56-126280

[51] Int. Cl.[4] ..... C22C 38/26; C22C 38/12

[52] U.S. Cl. ..... 75/123 N; 75/123 L; 75/126 C; 75/126 Q; 75/128 A; 75/128 C

[58] Field of Search ..... 75/123 K, 123 L, 123 M, 75/123 N, 123 J, 128 A, 128 C, 124 B, 36, 126 C, 126 Q

[56] References Cited

U.S. PATENT DOCUMENTS

| | | | |
|---|---|---|---|
| 3,726,724 | 4/1973 | Davies et al. | 75/123 R |
| 4,448,617 | 5/1984 | Yamamoto et al. | 75/123 L |

FOREIGN PATENT DOCUMENTS

| | | | |
|---|---|---|---|
| 1142890 | 1/1963 | Fed. Rep. of Germany | 75/123 N |
| 1386441 | 12/1964 | France | 75/123 N |
| 53-28516 | 3/1978 | Japan | 148/36 |
| 54-38571 | 11/1979 | Japan | 75/123 L |
| 5732353 | 8/1980 | Japan | 75/123 L |
| 399643 | 10/1933 | United Kingdom . | |
| 1052701 | 4/1963 | United Kingdom | 148/36 |
| 1163640 | 9/1969 | United Kingdom . | |
| 1187275 | 4/1970 | United Kingdom . | |
| 1478011 | 6/1977 | United Kingdom . | |
| 0301371 | 6/1971 | U.S.S.R. | 148/36 |
| 0584055 | 12/1977 | U.S.S.R. | 148/36 |

OTHER PUBLICATIONS

Dr. Toshiro Yamamoto et al., "(557) Role of Si and Cr in Spring Steel for High Stress Use", Mar. 5, 1982, Tetsu to Hagane, Journal of the Iron and Steel Institution of Japan, p. '81-S583.

Dr. Toshiro Yamamoto et al., "(558) Precipitation Strenghened Spring Steel for High Stress Use", Mar. 5, 1981, Tetsu to Hagane, Journal of the Iron and Steel Institution of Japan, p. '81-S584.

Toshiro Yamamoto et al., "Precipitation Strengthened Spring Steel for Automobile Suspensions", Feb. 22-26, 1982, Sae Technical Paper Series 820129.

*Primary Examiner*—L. Dewayne Rutledge
*Assistant Examiner*—Deborah Yee
*Attorney, Agent, or Firm*—Blum Kaplan Friedman Silberman & Beran

[57] ABSTRACT

A spring steel having a good sag-resistance and a good hardenability comprises by weight 0.5-0.8% carbon, 1.5-2.5% silicon, 1.6-2.5% manganese and a member or members selected from a group consisting of 0.05-0.5% vanadium, 0.05-0.5 niobium and 0.05-0.5% mobybdenum, the remainder being iron together with impurities. The steel may further contain a member or members selected from a group consisting 0.0005-0.01% boron, 0.2-1.0% chromium, 0.2-2.0% nickel and not greater than 0.3% rare-earth elements and/or a member or members selected from a group consisting of 0.03-0.1% aluminum, 0.02-0.1% titanium and 0.02-0.1% zirconium.

8 Claims, 9 Drawing Figures

SPRING STEEL HAVING A GOOD SAG-RESISTANCE AND A GOOD HARDENABILITY

BACKGROUND OF THE INVENTION

The present invention relates to a spring steel having a good sag-resistance and a good hardenability.

There has been an increasing demand for light weight suspension springs reflecting a trend for light weight automobiles, in recent years. As an attempt to meet such a demand, it is said to be an effective approach to the reduction of weight to design the springs to have an increased stress and to use them under a high stress state.

However, if presently available spring steels are used under a high stress condition, there will arise problems such as deterioration of their durability and increase of sagging, and the increased sagging will result in decreased height of the springs and hence decreased height of the vehicle, with the consequent decreased height of the bumper causing a serious problem from the standpoint of safety.

Under the circumstances, there has recently been a demand for a spring steel having a high sag-resistance which makes high stress designing possible.

Heretofore, as a spring steel superior in sag-resistance, the steel corresponding to SAE 9260 (Japan Industrial Standard SUP 7) has become more popular along with the finding that silicon contained in spring steels is effective in improving sag-resistance.

Conventional spring, however, have a drawback such that when forming the steels into springs having complicated shapes or when forming the steels into heavy springs, much time is required from when heating is ended until when quenching is completed, thus allowing ferrite and/or bainite to be produced in the hardened structure, and therefore a desired hardness in not obtained.

However, there were severe requirements for light weight suspension springs. Accordingly, it has been strongly desired to develop a spring steel having a sag-resistance superior to that of SAE 9260.

With these circumstances as background, the inventors of the present invention have previously developed a spring steel superior in the sag-resistance to the steel of SAE 9260 and equivalent to the steel of SAE 9620 in the fatigue resistance and toughness required of spring steels, by adding one or more of vanadium, niobium and molybdenum in an appropriate amount to a spring steel of high silicon content, and filed an application thereon (U.S. patent application Ser. No. 06/289,852).

However, in the cases of a thick coil spring, a thick torsion bar and a thick laminated leaf spring, which are used for relatively large-sized automobiles or the like, it is difficult to harden the material to its core portion during the heat treatment and consequently the structure of the core portion tends to be bainite or ferrite-pearlite which has a lower hardness than a martensite structure, and thus the effect of improving the sag-resistance by adding vanadium, niobium or molybdenum is greatly impaired.

SUMMARY OF THE INVENTION

A primary object of the present invention is to provide a spring steel having a good sag-resistance and a good hardenability.

Another object of the present invention is to provide a spring steel which permits a wide range of cooling rate during the quenching operation which cooling rate does not cause ferrite to be produced in the hardened structure.

A further object of the present invention is to provide a spring steel having a good hardenability without impairment of its sag-resistance which, even in the form of a thick coil spring, a thick torsion bar or a thick leaf spring, is capable of forming a martensite structure extending to the core portion by the heat treatment, by adding one or more of vanadium, niobium and molybdenum in an appropriate amount to a spring steel of high silicon content and by having a large amount of manganese contained therein.

A still further object of the present invention is to provide a spring steel having not only an improved sag-resistance but also a superior toughness and being equivalent to those of the steel corresponding to SAE 9260 in point of fatigue resistance required of spring steels, by adding boron and/or chromium to the above-mentioned steel, if required, to further improve the hardenability of the steel, by adding nickel and/or rare-earth elements thereto to improve the toughness of the steel and by further adding aluminum, titanium and/or zirconium for refining grains to improve the sag-resistance of the steel.

Thus, the present invention provides a spring steel comprising, by weight, 0.5–0.8% carbon, 1.5–2.5% silicon, 1.6–2.5% manganese and a member of members selected from a group consisting of 0.05–0.5% vanadium, 0.05–0.5% niobium and 0.05–0.5% molybdenum, the remainder being iron except for impurities normally associated with these metals.

Further, the steel of the present invention may additionally contain a number of members selected from the group consisting of 0.0005–0.01% boron, 0.2–1.0% chromium, 0.2–2.0% nickel and not more than 0.3% rare-earth elements and/or a member or members selected from the group consisting of 0.03–0.1% aluminum, 0.02–0.1% titanium and 0.02–0.1% zirconium.

BRIEF DESCRIPTION OF THE DRAWINGS

A better understanding of the prior art and of the present invention will be obtained by reference to the detailed description below, and to the attached drawings, in which.

DETAILED DESCRIPTION OF THE PREFERRED EMBODIMENTS

Figure 1:
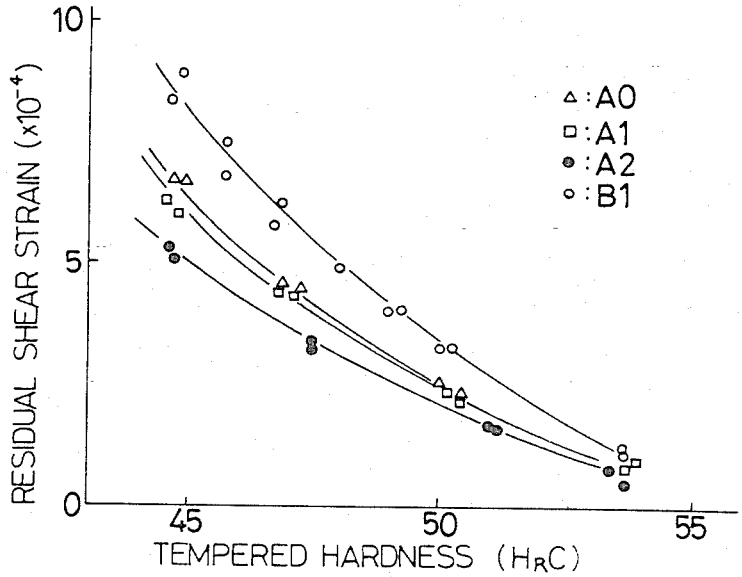
FIGS. 1 to 4 are diagrams illustrating the sagging of specimens of $H_RC$ 45–55 obtained from steels according to the present invention and conventional steel after quenching and tempering treatments.

The present invention relates to a spring steel having a good sag-resistance and a good hardenability.

The spring steel according to the present invention contains, by weight, 0.5–0.8% carbon, 1.5–2.5% silicon, 1.6–2.5% manganese and a member or members selected from a group consisting of 0.05–0.5% vanadium, 0.05–0.5% niobium and 0.05–0.5% molybdenum, the remainder being iron except for impurities normally associated with these metals, (this steel will be hereinafter referred to as the "first invention steel"). The spring steel according to the present invention may further contain in addition to the components of the first invention steel, a member or members selected from a group consisting of 0.0005–0.01% boron, 0.2–1.0% chromium, 0.2–2.0% nickel and not more than 0.3% rare-earth elements (this steel will be hereinafter referred to as the "second invention steel"). The second invention steel is improved in the hardenability and toughness from the first invention steel. Furthermore, the spring steel according to the present invention may further contain in addition to the components of the first and second invention steels a member or members selected from a group consisting of 0.03–0.1% aluminum, 0.02–0.1% titanium and 0.02–0.1% zirconium (this steel will be hereinafter referred to as the "third invention steel"). The third invention steel is improved in sag-resistance by refining grains of the first and second invention steels.

The sag-resistance of the steel of the present invention is improved by the addition of vanadium, niobium and molybdenum, and this is because of the following mechanism.

Vanadium, niobium and molybdenum form carbides in the steel. The vanadium carbide, niobium carbide and molybdenum carbide (hereinafter referred to as "alloy carbide") are dissolved in austenite by the heating at the time of the quenching operation, and when rapidly cooled for quenching, these elements are supersaturated in martensite structure in a solid solution state. When tempered, a fine alloy carbide starts to reprecipitate during the tempering operation, causing a secondary hardening to take place, which prevents the movement of dislocation in the steel, thereby improving the sag-resistance.

Moreover, an alloy carbide not dissolved in the austenite by the heating at the time of the quenching operation serves to refine austenite grains and prevent coarsening of the grains. Such fine grains serve to reduce the movement of dislocation and thereby to improve the sag-resistance.

Furthermore, the steel of the present invention thus incorporated with niobium, vanadium and molybdenum undergoes a secondary hardening by the reciprocation of the alloy carbide in the tempering operation subsequent to the quenching operation which may be carried out from the austenitizing temperature of 900° C. normally used for the ordinary spring steels. This means that in the case of aiming at the same tempered hardness range, it is possible to obtain a wider temperature range for tempering as compared with a conventional steel and to obtain the aimed hardness assuredly.

As to manganese, its high content ranging from 1.60 to 2.50% will improve the hardenability, afford a sufficient sag-resistance and strengthen ferrite. Besides, since manganese causes ferrite transformation initiation line to move to the right in the continuous cooling transformation diagram, it stabilizes the forming operation from the end of heating.

Among boron, chromium, nickel and rare-earth elements which improve hardenability, particularly boron is effective also in improving sag-resistance.

More particularly, atomic boron is dissolved interstitially in crystals, and it is apt to penetrate particularly in the vicinity of the dislocation. The dislocation thus penetrated by boron is hardly movable, and the sagging is thereby effectively reduced.

The grain refining elements such as aluminum, titanium and zirconium form a nitride in the steel, and this nitride plays an effective role not only for refining austenite grains but also preventing coarsening thereof in the heating at the time of the quenching operation. Such fine grains serve to reduce the movement of dislocation and thereby improve the sag-resistance.

Furthermore, in the cases of a thick coil spring, a thick torsion bar and a thick laminated leaf spring, which are used in large-sized automobiles or the like, the addition of boron, chromium, nickel and rare-earth elements for further improving hardenability permits a martensite structure to be obtained up to the core portion at the time of heat treatment, without impairment of sag-resistance.

The following are reasons for the numerical limitations on the components of the steel of the present invention.

The reason for restricting the amount of carbon to 0.5~0.8% is that if the amount is less than 0.5%, a sufficient stength for use as a high-stress spring steel is not obtainable by quenching and tempering, and if the amount exceeds 0.8%, a hyper-eutectoid steel results which has a substantially reduced toughness.

The reason for restricting the amount of silicon to 1.5–2.5% is that if the amount is less than 1.5%, the effect of silicon for strengthening the matrix and improving the sag-resistance by being dissolved in ferrite is not fully attained, and if the amount exceeds 2.5%, the effect of improving the sag-resistance is saturated and there is a possiblity of undesirable formation of free carbon by the heat treatment.

Manganese plays a role of improving the strength of the matrix and improving the hardenability, thereby improving the sag-resistance when dissolved in ferrite, the reason for restricting the amount of manganese to 1.6–2.5% is that if its amount is less than 1.6%, the effect of improving the hardenability and the foregoing effect of moving ferrite transformation initiation line are insufficient, and if its amount exceeds 2.5%, the effect of improving the sag-resistance is saturated, there is a possibility of deteriorating the toughness after quenching and tempering remarkably and also there is a possibility of presenting a large amount of retained austenite.

Each of vanadium, niobium and molybdenum plays a role of improving the sag-resistance of the steel according to the present invention. The reason for restricting the amount of each of vanadium, niobium and molybdenum which fulfil such a function to 0.05–0.5% is that if the amount is less than 0.05%, the above effectiveness is not sufficiently obtainable, and if the amound exceeds 0.5%, the effectiveness is saturated and the amount of the alloy carbide not dissolved in the austenite increases and produces large aggregates acting as non-metallic inclusions thus leading to a possibility of decreasing the fatigue strength of the steel.

These vanadium, niobium and molybdenum may be added alone independently of the other two, or they may be added as a combination of two or three, whereby it is possible to form a preferred system where their solubilization in the austenite starts at a lower temperature than the case where vanadium, niobium and molybdenum are added alone, and the precipitation of the fine alloy carbide during the tempering operation facilitates the secondary hardening thereby further improving the sag-resistance.

The reason for restricting the amount of boron to 0.0005–0.01% is that if the amount is less than 0.0005%, no adequate improvements in the hardenability and sag-resistance are obtainable and if the amount exceeds 0.01%, boron compounds precipitate which leads to hot brittleness.

The reason for restricting the amount of chromium to 0.2–1.0% is that if the amount is less than 0.2%, no adequate effectiveness for hardenability is obtainable, and if the amount exceeds 1.0%, the uniformity of the structure is impaired in a high silicon content steel as used in the present invention and consequently the sag-resistance is impaired.

Nickel or rare-earth elements plays a role of improving the hardenability and toughness of the steel of the present invention. The reason for restricting the amount of nickel to 0.2–2.0% is that if the amount is less than 0.2%, the effect of improving the hardenability and toughness is not fully attained, and if the amount exceeds 2.0%, there is a possibility of forming a large amount of retained austenite in the quenching operation. Rare-earth elements, as well as nickel, also plays a role for improving the hardenability and toughness of the steel, and the reason for restricting the amount thereof to not more than 0.3% is that the amount exceeding 0.3% is likely to cause coarsening of grains.

Each of aluminum, titanium and zirconium plays a role for refinement of grains and thereby improve the sag-resistance of the steel of the present invention. The reason for restricting the amounts of aluminum, titanium and zirconium to 0.03–0.1%, 0.02–0.1% and 0.02–0.1%, respectively, is that if their amounts are less than the respective lower limits, a sufficient effect of improving the sag-resistance is not obtainable, and if their amounts exceed the respective upper limits, the amount of nitrides of aluminum, titanium and zirconium increases and produces large aggregates acting as non-metallic inclusions thus leading to a possibility of decreasing the fatigue strength of the steel.

Features of the steel of the present invention will be clarified hereinunder in terms of working examples in comparison with the conventional steel.

EXAMPLE 1

Table 1 below shows chemical compositions of sample steels.

TABLE 1

| | Chemical Compositions (% by weight) | | | | | | | | | | |
|---|---|---|---|---|---|---|---|---|---|---|---|
| | C | Si | Mn | V | Nb | B | Cr | Ni | R.E.M | Al | Ti |
| A0 | 0.63 | 1.95 | 1.88 | | 0.23 | | 0.11 | 0.06 | | 0.025 | |
| A1 | 0.58 | 2.03 | 1.94 | 0.27 | | | 0.12 | 0.06 | | 0.023 | |
| A2 | 0.59 | 2.10 | 1.98 | 0.19 | 0.08 | | 0.13 | 0.07 | | 0.020 | |
| A3 | 0.57 | 2.01 | 1.76 | 0.25 | | 0.0045 | 0.11 | 0.07 | | 0.025 | |
| A4 | 0.61 | 1.97 | 1.71 | 0.18 | 0.08 | 0.0052 | 0.12 | 0.07 | | 0.027 | |
| A5 | 0.60 | 2.02 | 1.82 | 0.25 | | | 0.48 | 0.06 | | 0.021 | |
| A6 | 0.58 | 1.93 | 1.75 | 0.17 | 0.07 | | 0.50 | 0.06 | | 0.022 | |
| A7 | 0.62 | 2.07 | 1.77 | 0.26 | | 0.0034 | 0.12 | 0.98 | | 0.025 | |
| A8 | 0.59 | 2.05 | 1.73 | 0.19 | 0.08 | 0.0042 | 0.12 | 1.02 | | 0.018 | |
| A9 | 0.59 | 2.01 | 1.68 | 0.27 | | 0.0029 | 0.10 | 0.07 | 0.12 | 0.024 | |
| A10 | 0.60 | 2.08 | 1.85 | 0.17 | 0.08 | 0.0040 | 0.14 | 0.08 | 0.15 | 0.023 | |
| A11 | 0.61 | 2.00 | 2.01 | 0.30 | | | 0.11 | 0.07 | | 0.053 | |
| A12 | 0.57 | 1.96 | 1.94 | 0.18 | 0.07 | | 0.10 | 0.05 | | 0.047 | |
| A13 | 0.61 | 2.03 | 1.97 | 0.27 | | | 0.13 | 0.06 | | 0.021 | 0.08 |
| A14 | 0.58 | 2.07 | 1.90 | 0.17 | 0.09 | | 0.12 | 0.06 | | 0.026 | 0.06 |
| A15 | 0.60 | 2.01 | 1.92 | 0.28 | | 0.0035 | 0.12 | 0.07 | | 0.042 | 0.08 |
| A16 | 0.62 | 2.05 | 1.86 | 0.20 | 0.07 | 0.0042 | 0.12 | 0.07 | | 0.037 | 0.08 |
| B1 | 0.59 | 2.11 | 0.86 | | | | 0.13 | 0.05 | | 0.023 | |

In Table 1, A0 to A16 steels are of the present invention, of which A0 to A2 steels correspond to the first invention steel, A3 to A10 steels correspond to the second invention steel and A11 to A16 steels correspond to the third invention steel, while B1 steel is a conventional steel corresponding to SAE 9260.

Using the sample steels A0 to A2, and A11 to A16 and B1 steel shown in Table 1 as base materials, coil springs having the characteristics shown in Table 2 were prepared and then subjected to quenching and tempering treatments to bring the final hardness to $H_RC$ 45–55. Then, they are subjected to pre-setting to bring the shear stress of bars to $\tau=115$ kg/mm$^2$ to obtain specimens for sagging test. These specimens were brought under a load sufficient to give a shear stress of the bars being $\tau=105$ kg/mm$^2$ at a constant temperature of 20° C., and after the expiration of 96 hours (hereinafter referred to as "long hour loading"), the sagging of the coil springs was measured.

TABLE 2

| Characteristics of the Coil Springs | |
|---|---|
| Bar diameter (mm) | 13.5 |
| Bar length (mm) | 2470 |
| Average coil diameter (mm) | 120 |
| Number of turns | 6.75 |
| Effective number of turns | 4.75 |
| Spring rate (kgf/mm) | 4.05 |

Figure 2:
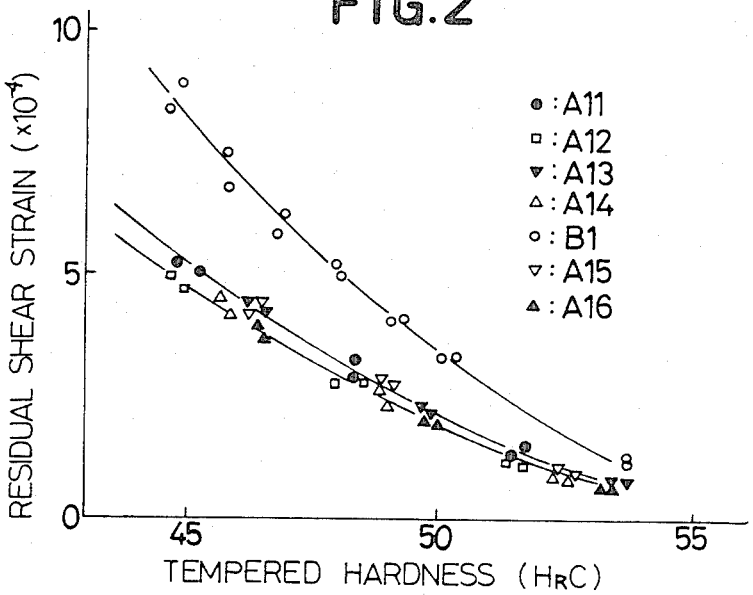

Further, the sagging corresponding to the hardness of the above specimens is as shown in FIGS. 1 and 2. As is apparent from FIG. 1 that the steels of the present invention containing vanadium and/or niobium in addition to an increased amount of manganese are all superior in sag-resistance to that of the conventional B1 steel. From FIG. 2, moreover, it is noted that the steels of the present invention containing vanadium and/or niobium and further containing aluminum and/or titanium in addition to the increased amount of manganese are also superior in sag-resistance to that of the conventional B1 steel.

Further, in order to determine the sagging, a load $P_1$ required to compress the coil springs to a predetermined level prior to the aforesaid long hour loaidng and a load $P_2$ required to compress them to the same level after exerting the long hour loading, were measured, and the sagging was calculated by applying the difference $\Delta P(=P_1-P_2)$ to the following equation, and the sagging was evaluated by values having a unit of shear strain and referred to as "residual shear strain".

$$\gamma R = \frac{1}{G} \cdot K \frac{8D}{\pi d^3} \Delta P$$

G: Shear modulus (kgf/mm$^2$)
D: Average coil diameter (mm)
d: Bar diameter (mm)
K: Wahl's coefficient (a coefficient depending upon the shape of a coil spring)

Figure 6:
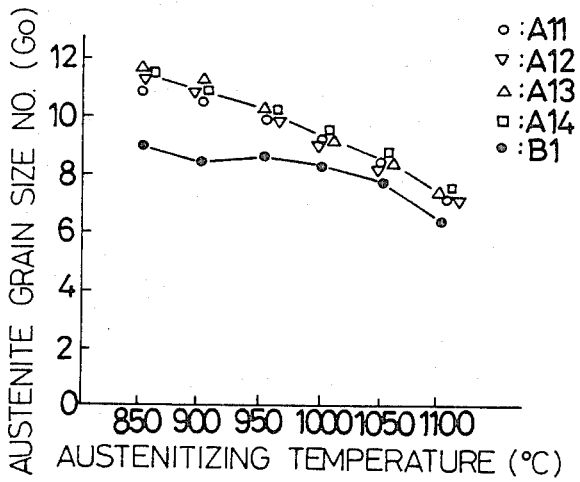
FIGS. 6 and 7 are diagram illustrating austenite grain sizes of A11 to A14 steels, A3 to A6 steels and B1 steel after heating at a austenitizing temperature from 850° to 1,100° C.

Then, the sample steels A11 to A14 and B1 steel were heated at temperatures ranging from 850° to 1,100° C. and their austenite grain sizes were determined according to the oxidation method, the results of which are as shown in FIG. 6. As is apparent from FIG. 6, the A11 to A14 steels containing aluminum and/or titanium in addition to vanadium and/or niobium afford finger grains than B1 steel corresponding to SAE 9260.

Further, with respect to coil spring bars having the same characteristics as above made of the A1, A2, A11 to A16 steels of the present invention and of the conventional B1 steel, a load to give a shear stress varying from 10 to 110 kgf/mm$^2$ was repeatedly exerted for fatigue tests. Upon the repitition of the loading for 200,000 times, no breakage was observed in any one of the coil springs.

Using the above sample steels A3 to A10 and B1 steel as base materials, torsion bars having the characteristics shown in Table 3 and a diameter of 30 mm at the parallel portions, were prepared, then subjected to quenching and tempering treatments to bring the final hardness to a level of $H_RC$ 45 to 55 and thereafter to a shor-peening treatment, thereby to obtain specimens for sagging tests. Prior to the sagging test, a torque to give a shear stress $\tau=110$ kgf/mm$^2$ to the surface of the parallel portions of the specimens was exerted to both ends of the specimens and thus pre-setting thereby applied. After the pre-setting, a torque to give a shear stress $\tau=100$ kgf/mm$^2$ was exerted and the specimens were kept to stand in that state for 96 hours. Thereafter, the residual shear strain was calculated by the equation $Y_R=\Delta\theta \cdot d/2l$ based on the decrease of the torsional angle, where $Y_R$ is a residual shear strain, $\Delta\theta$ is a decrease (rad) of the torsional angle and d is a diameter (mm) of the bar.

TABLE 3

| Characteristics of the Torsion Bars | |
|---|---|
| Bar diameter | 30.0 mm |
| Effective bar length | 840 mm |
| Spring rate | 12,723 kgf mm/deg |

Figure 3:
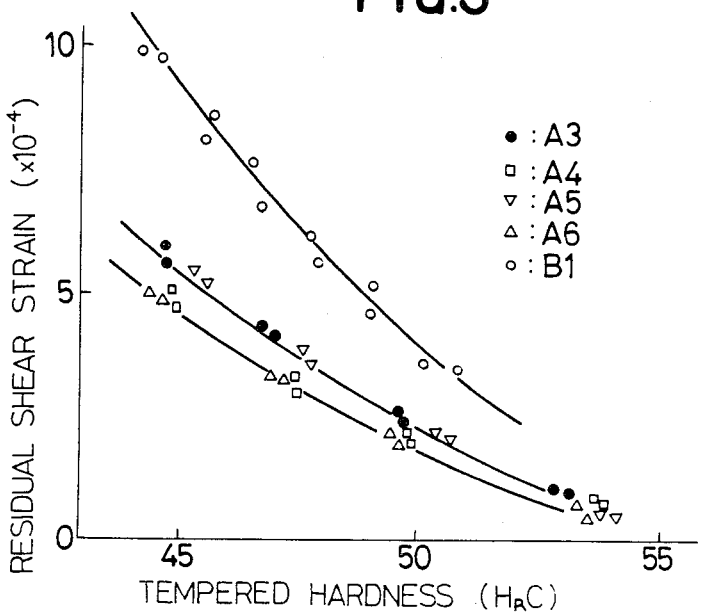
Figure 4:
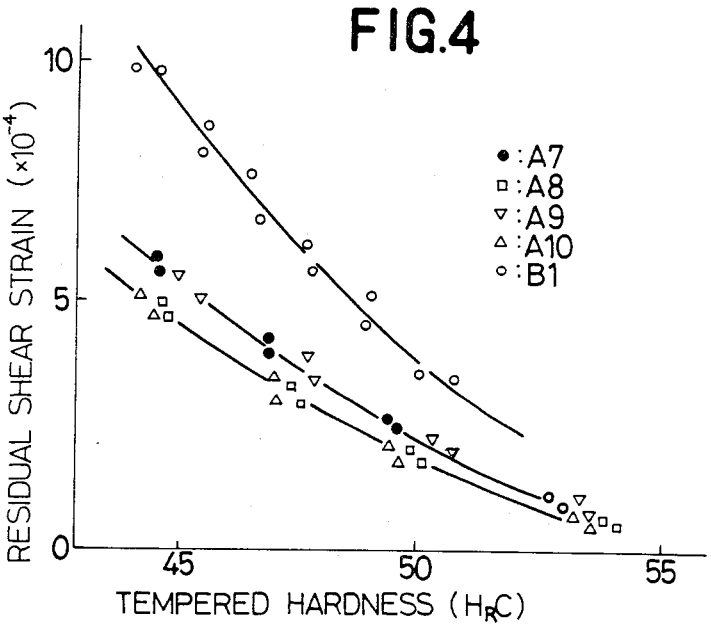

The sagging corresponding to the hardness of the above specimens is as shown in FIGS. 3 and 4, from which it is apparent that the specimens having a diameter of 30 mm at the parallel portions and prepared from A3 to A10 steels of the present invention containing boron, chromium, nickel and/or rare-earth elements are remarkably superior in the sagging as compared with the conventional B1 steel. This is presumed to be due to the fact that by the incorporation of boron, it was possible to obtain by the quenching treatment a fully hardened martensite structure to the core thereof without impairing the sag-resistance even when a torsion bar having a diameter of 30 mm was used, and at the same time boron penetrated interstitially into crystals in the vicinity of the dislocation thereby preventing the movement of the dislocation to effectively reduce the sagging.

Figure 5:
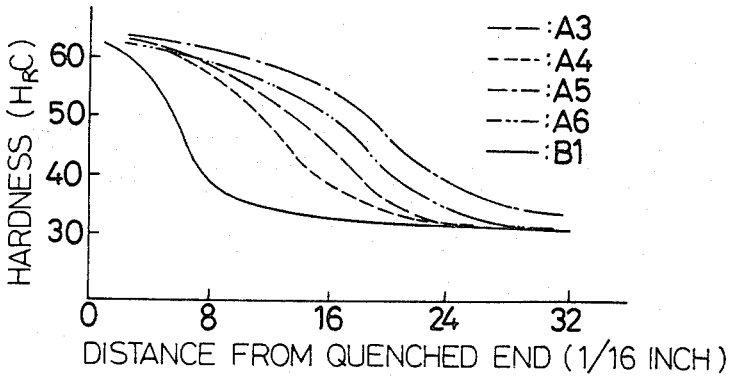
FIG. 5 is a diagram illustrating hardenability of A3 to A6 steels and B1 steel.

The Jominy curves of the sample steels A3 to A6 and B1 steel are shown in FIG. 5, from which it is apparent that A3 to A6 steels containing boron, chromium, nickel and rare-earth elements are remarkably improved in their hardenability as compared with B1 steel not containing those components.

Figure 7:
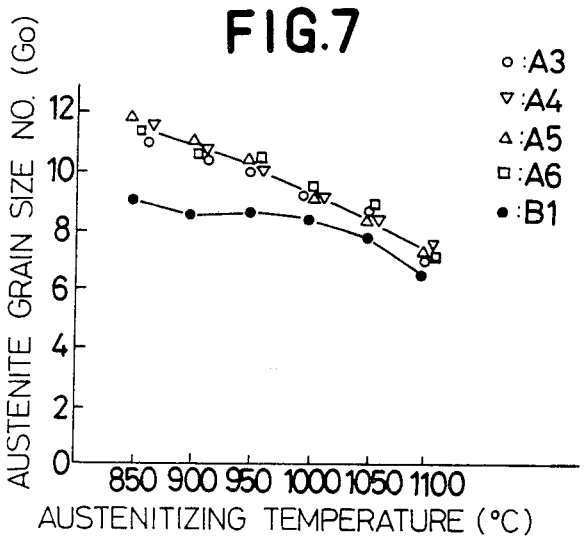

FIG. 7 shows austenite grain sizes of A3 to A6 steels and B1 steel as measured according to the oxidation method after heating at an austenitizing temperature of from 850° to 1,100° C. It is apparent from FIG. 7 that A3 to A6 steels containing boron, chromium and nickel in addition to containing vanadium and niobium have an austenite grain size equivalent to that of A1 steel containing vanadium alone. This indicates that the effectiveness of the alloy carbide for the refinement of crystal grains and for the prevention of coarsening of the austenite grains, is not impaired by the addition of boron, chromium and nickel.

Furthermore, the sample steels A3 to A10 and B1 steel shown in Table 1 were subjected to quenching and tempering treatments so as to give the final hardness of approximately $H_RC$ 48 and then subjected to impact testing. Impact values, which were measured using ASTM E23 Type C specimens (JIS No. 3 U-notch Charpy specimens), are as shown in Table 4.

TABLE 4

| | Hardness ($H_RC$) | Impact Value (kgf · m/cm$^2$) |
|---|---|---|
| A3 | 47.6 | 2.3 |
| A4 | 47.2 | 2.6 |
| A7 | 47.1 | 3.5 |
| A8 | 47.3 | 3.2 |
| A5 | 47.8 | 2.5 |
| A6 | 47.5 | 2.3 |
| A9 | 48.6 | 3.3 |
| A10 | 47.3 | 3.5 |
| B1 | 47.1 | 2.6 |

As is apparent from Table 4 that A7, A8, A9 and A10 steels containing nickel or rare-earth elements are superior in toughness to that of A3, A4, A5, A6 and B1 steels not containing such component, and that the addition of nickel or rare-earth elements results in improvement not only in hardenability but also in toughness.

Furthermore, with respect to the aforementioned torsion bars made of the A3 to A10 steels of the present invention and of the conventional B1 steel, a load to give a shear stress of 60±50 kgf/mm$^2$ was repeatedly exerted for fatigue test. Upon the repetition of the loading for 200,000 times, no breakage was observed in any one of the torsion bars. This indicates that the addition of boron does not affect the fatigue life.

Figure 8:
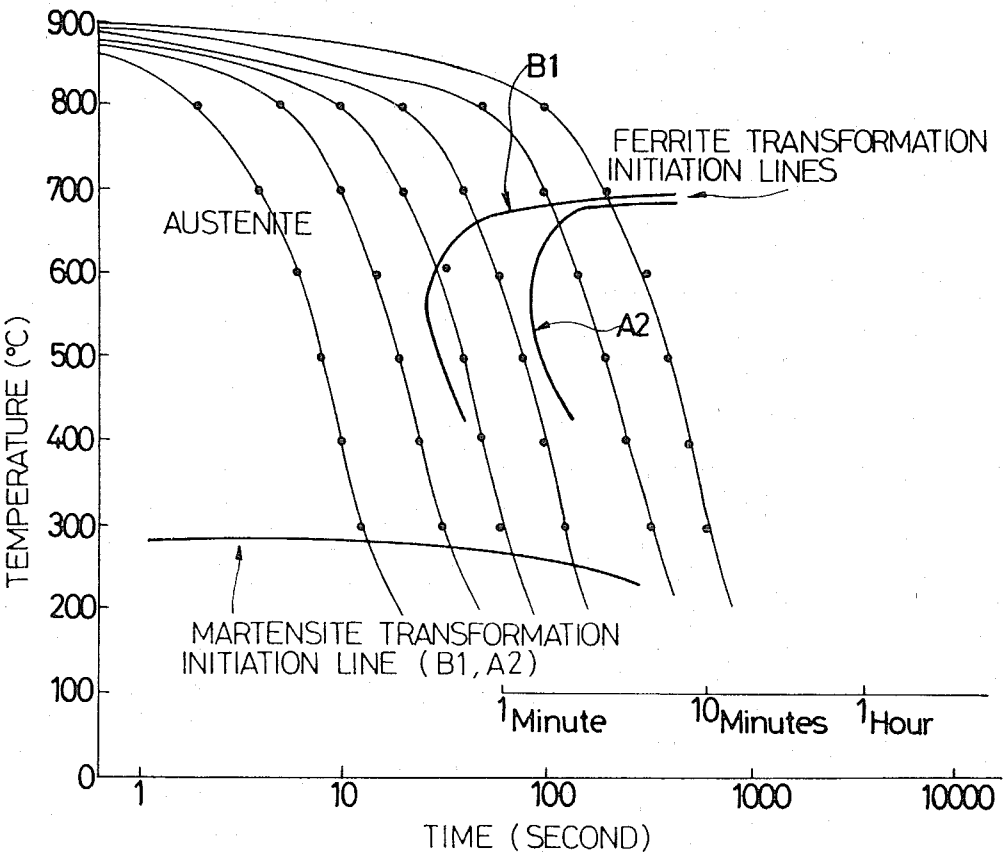
FIG. 8 is a continuous cooling transformation diagram of A2 and B1 steels.

FIG. 8 is a continuous cooling transformation diagram of spring steels, in which both a martensite transformation initiation line of the steel of the invention and a ferrite transformation initiation line of A2 steel were entered. As compared with a ferrite transformation initiation line of the conventional B1 steel which was also entered therein for comparison purpose, the ferrite transformation initiation line of A2 steel is positioned more to the right, indicating that the range of cooling rate at which ferrite is not produced during the forming operation from the end of heating, is wider than that of B1 steel.

As described hereinabove, the steel of the present invention comprises a conventional spring steel of high silicon content in which the amount of manganese is increased and proper amounts of vanadium, niobium and molybdenum are added alone or in combination, and which further contains, if required, one or more of boron, chromium, nickel and rare-earth elements, and which further contains, if required, one or more of aluminum, titanium and zirconium, whereby the hardenability and sag-resistance of the conventional high silicon content spring steel have successfully been remarkably improved. At the same time, the steel of the present invention is as good as the conventional steels in the fatigue resistance and toughness which are required for spring steels, and it is extremely usuful for practical applications particularly as a steel for a vehicle suspension spring.

Now, a high temperature rapid heating operation will be described which further improves the sag-resistance of the steel of the present invention.

Figure 9:
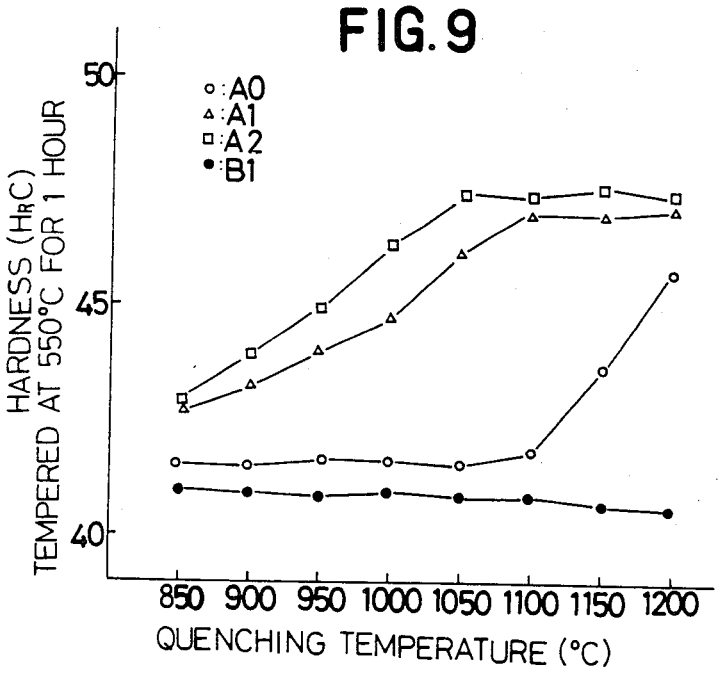
FIG. 9 is a diagram showing the relationship between the quenching temperature and the hardness.

FIG. 9 shows the hardness of the above steels which were heated at austenitizing temperatures within a range from 850° to 1200° C. and tempered at 550° C. It is seen from FIG. 9 that with respect to A0, A1 and A2 steels, except for B1 steel, the hardness is increased with an increase of the austenitizing temperature. This indicates that the amount of the alloy carbide dissolved in the austenite phase increases with an increase of the austenitizing temperature and the secondary hardening is thereby facilitated remarkably. And further, it is apparent from FIG. 9 that the steel containing vanadium and niobium in a combination has a hardness superior to the steels in which vanadium or niobium is added alone.

Namely, by setting the heating temperature for austenitizing at a higher level of from 900° to 1200° C. than the conventional method, it is possible to increase the amounts of carbides of vanadium, niobium and molybdenum dissolved in the austenite. Accordingly, it is thereby possible to increase the precipitation of the fine carbides in the subsequent tempering and to further facilitate the secondary hardening, whereby it is possible to further improve the sag-resistance.

However, if the heating is conducted at a temperature as high as from 900° to 1200° C. for a long period of time by the conventional heating method such as with a heavy oil, there will be adverse effects such that decarburization takes places on the steel surface, the surface becomes rough, the fatigue life is shortened and the austenite grains are coarsened.

Under these circumstances, the present inventors have conducted extensive researches, and have found that by rapidly heating the steel materials to a temperature of from 900° to 1200° C. at the time of austenitizing, it is possible to dissolve carbides of vanadium, niobium and molybdenum in a great amount in the austenite without bringing about decarburization and surface roughening, and by holding the steel materials at the temperature for a predetermined period of time, thereafter quenching them and then subjecting them to tempering at a temperature of from 400° to 580° C., it is possible to precipitate fine carbides in a great amount to further facilitate the secondary hardening, whereby it is possible for further improve the sag-resistance.

Now, the reasons for restricting the high temperature rapid heating will be explained.

The reason for restricting the heating temperature for austenitizing to from 900° to 1200° C, is that if the temperature is lower than 900° C., it is impossible to to adequately dissolve vanadium, niobium and molybdenum in the austenite especially when they are added alone, and if the temperature exceeds 1200° C., it is likely that decarburization or surface roughening forms on the surface of the steel materials.

Further, the reason for carrying out the heating rapidly, is that if the heating rate is less than 500° C./min, the heating time at the high temperature is required to be long thereby leading to adverse effects such as the formation of decarburization on the surface of the steel materials, the surface roughening, the decrease of the fatigue life, and the coarsening of the austenite grains.

To carry out the rapid heating at a rate of at least 500° C./min, it is preferred to use a high frequency induction heater or a direct current heating apparatus.

Further, the reason for restricting the tempering temperature to from 400° to 580° C. is that in the steel of the present invention, carbides of vanadium, niobium and molybdenum dissolved in the austenite, are precipitated as a fine alloy carbide during the tempering treatment and a secondary hardening is thereby caused to take place, whereby even when the tempering is carried out at a temperature as high as 580° C., the decrease of the hardness is smaller than the conventional steels and it is possible to obtain a hardness of at least $H_RC$ 44.5.

This will be explained in more detail with reference to the following Example.

EXAMPLE 2

As the sample materials, there were used the steels of the invention identified by A2, A4, A8 and A16 in Table 1, and the conventional steel identified by B1 also in Table 1 and composed substantially of SAE 9260.

The sample steels were cast, subjected to hot rolling at a rolling ratio of at least 50, and then rapidly heated at a heating rate of 1000° C./min or 5000° C./min to 950° C. and 1050° C. at the time of quenching and then tempered to give a tempered hardness of about $H_RC$ 48. The sagging 'i.e. the residual shear strain), decarburization and austenite grain sizes thereby obtained are shown in Table 5.

The measurement of the sagging was carried out in the same manner as in Example 1 with use of coil springs in respect of materials having a diameter of 13.5 mm and with use of torsion bars in respect of materials having diameter of 30 mm.

Further, the decarburization was measured by JIS G 0558 (SAE J 419) method, and the austenite grain sizes were measured by JIS G 0551 (ASTM E 112) quenching and tempering (Gh) method.

TABLE 5

| | Sample materials | bar diameter (mm) | Heating rate (°C./min) | Austenitizing temperatures (°C.) | Tempering Temperatures (°C.) | Sagging($10^{-4}$) (Residual shear strain) | Decarburization (mm) | Austenite grain sizes (Go) |
|---|---|---|---|---|---|---|---|---|
| High temperature rapid heating | A2 | Coil spring 13.5 | 1000 | 950 | 470 | 3.0 | 0.02 | 11.2 |
| | " | Coil spring 13.5 | 5000 | 1050 | 480 | 2.7 | 0.04 | 10.7 |

TABLE 5-continued

| | Sample materials bar diameter (mm) | | Heating rate (°C./min) | Austenitizing temperatures (°C.) | Tempering Temperatures (°C.) | Sagging($10^{-4}$) (Residual shear strain) | Decarburization (mm) | Austenite grain sizes (Go) |
|---|---|---|---|---|---|---|---|---|
| | A4 | Coil spring 13.5 | 1000 | 950 | 470 | 2.9 | 0.02 | 11.6 |
| | " | Coil spring 13.5 | 5000 | 1050 | 480 | 2.7 | 0.03 | 10.9 |
| | A16 | Coil spring 13.5 | 1000 | 950 | 470 | 2.7 | 0.03 | 11.5 |
| | " | Coil spring | 5000 | 1050 | 480 | 2.5 | 0.04 | 10.8 |
| | A8 | Torsion bar 30 | 1000 | 1050 | 480 | 2.8 | 0.03 | 10.8 |
| | A16 | Torsion bar 30 | 1000 | 1050 | 480 | 2.7 | 0.03 | 10.6 |
| Conventional Method | B1 | Coil spring 13.5 | 50 | 950 | 450 | 4.4 | 0.12 | 7.7 |
| | " | Torsion bar 30 | 50 | 1050 | 450 | 6.1 | 0.17 | 7.0 |

As is apparent from Table 5, the sagging of the coil springs having a diameter of 13.5 mm and prepared by the high temperature rapid heating was $2.5\text{–}3.0\times10^{-4}$, whereas the sagging of the coil springs prepared under the conventional heating conditions was $4.4\times10^{-4}$ thus showing that the values obtained by the invention were much superior to those of the conventional method.

Likewise, the sagging of torsion bars having a diameter of 30 mm was $2.7\text{–}2.8\times10^{-4}$ thus indicating superior values equivalent to the above coil springs.

From the above, it is apparent that the springs prepared by applying the high temperature rapid heating to the above steels of the present invention, have a superior sag-resistance.

Namely, by the application of the high temperature rapid heating to the above steels of the present invention, it was possible to dissolve a great amount of carbides of vanadium, and niobium in the austenite and to precipitate a great amount of fine carbides in the subsequent tempering step, whereby the secondary hardening was facilitated and the sag-resistance was thereby improved.

When the heating rate was as high as 1000° C./min or 5000° C./min with use of the high temperature rapid heating, even if the heating was conducted at a temperature as high as from 950° to 1050° C., it was possible to suppress the decarburization amount as low as from 0.02 to 0.04 mm as compared with from 0.12 to 0.17 mm according to the conventional method.

Further, if the high temperature rapid heating was applied to the above steels of the present invention, even when the heating was conducted at a temperature as high as 950° C. to 1050° C., it was possible to obtain an austenite grain size as fine as from 10.6 to 11.6 as compared with from 7.0 to 7.7 according to the conventional method, and thus a superior effect for the prevention of coarsening of austenite grains was obtainable.

As is apparent from the above results, in the case where a high temperature rapid heating is applied to the steel of the present invention, even when it is heated at a temperature as high as e.g. 1050° C., the decarburization amount is less than that by the conventional method and the austenite grain size is finer than attainable by the conventional method. Further, with respect to fatigue property, it has been confirmed that no breakage is observable in any one of the sample materials when they were subjected to a repeated loading for 200,000 times according to the fatigue test conducted by the method described in Example 1.

What is claimed is:

1. A spring steel having a good sag-resistance and a good hardenability consisting essentially of by weight 0.5–0.8% carbon, 1.5–2.5% silicon, 1.6–2.5% manganese and a member or members selected form a group consisting of 0.05–0.5% vanadium, 0.05–0.5% niobium and 0.05–0.5% molybdenum, the remainder being iron together with impurities.

2. A steel according to claim 1 wherein the steel comprises by weight 0.5–0.65% carbon, 1.8–2.2% silicon, 1.6–2.0% manganese and a member or members selected form a group consisting of 0.05–0.5% vanadium, 0.05–0.5% niobium and 0.05–0.5% molybdenum, the remainder being iron together with impurities.

3. A steel according to claim 1 wherein the steel comprised by weight 0.5–0.8% carbon, 1.5–2.5% silicon, 1.6–2.5% manganese and a member or members selected from a group consisting of 0.05–0.25% vanadium, 0.05–0.25% niobium and 0.05–0.25% molybdenum, the remainder being iron together with impurities.

4. A steel according to claim 2 wherein the steel comprises by weight 0.5–0.65% carbon, 1.8–2.2% silicon, 1.6–2.0% manganese and a member or members selected from a group consisting of 0.05–0.25% vanadium, and 0.05–0.25% niobium and 0.05–0.25% molybdenum, the remainder being iron together with impurities.

5. A spring steel having a good sag-resistance and a good hardenability consisting essentially of by weight 0.5–0.8% carbon, 1.5–2.5% silicon, 1.6–2.5% manganese, a member or members selected from a group consisting of 0.05–0.5% vanadium, 0.05–0.5% niobium and 0.05–0.5% molybdenum, and a member or members selected from a group consisting of 0.0005–0.01% boron, 0.2–1.0% chromium, 0.2–2.0% nickel and not greater than 0.3% rare-earth elements, the remainder being iron together with impurities.

6. A steel according to claim 5 wherein the steel comprises by weight 0.5–0.65% carbon, 1.8–2.2% silicon, 1.6–2.0% manganese, a member or members selected from a group consisting of 0.05–0.5% vanadium, 0.05–0.5% niobium and 0.05—0.5% molybdenum, and a member or members selected from a group consisting of 0.0005–0.01% boron, 0.2–1.0% chromium, 0.02–2.0% nickel and not greater than 0.3% rare-earth elements, the remainder being iron together with impurities.

7. A steel according to claim 5 wherein the steel comprises by weight 015–0.8% carbon, 1.5–2.5% silicon, 1.6–2.5% manganese, a member or members selected from a group consisting of 0.05–0.25% vanadium, 0.05–0.25% niobium and 0.05–0.25% molybdenum and a member or members selected from a group consisting of 0.0005–0.01% boron, 0.2–1.0% chromium, 0.2–2.0% nickel and not greater than 0.3% rare-earth elements, the remainder being iron together with impurities.

8. A steel according to claim 6 wherein the steel comprises by weight 0.5–0.65% carbon, 1.8–2.2% silicon, 1.6–2.0% manganese, a member or members selected from a group consisting of 0.05–0.25% vanadium, 0.05–0.25% niobium and 0.05–0.25% molybdenum and a member or members selected from a group consisting of 0.0005–0.01% boron, 0.2–1.0% chromium, 0.2–2.0% nickel and not greater than 0.3% rare-earth elements, the remainder being iron together with impurities.

* * * * *